US006289941B1

(12) United States Patent
Debaes

(10) Patent No.: US 6,289,941 B1
(45) Date of Patent: Sep. 18, 2001

(54) METHOD FOR WEAVING A FALSE BOUCLE FABRIC

(75) Inventor: Johnny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/468,301

(22) Filed: Dec. 21, 1999

(30) Foreign Application Priority Data

Dec. 23, 1998 (BE) ..... 09800929

(51) Int. Cl.[7] ..... D03D 27/06

(52) U.S. Cl. ..... 139/402; 139/21; 139/37; 139/435.1; 139/398; 28/1; 28/72

(58) Field of Search ..... 139/402, 37, 435.1, 139/383 R, 404, 416, 391; 28/1, 72

(56) References Cited

U.S. PATENT DOCUMENTS

| | | | | |
|---|---|---|---|---|
| 2,247,308 | * | 6/1941 | Redman | 28/1 |
| 3,013,325 | * | 12/1961 | McNally et al. | 28/72 |
| 3,327,738 | * | 6/1967 | Sabbe | 139/398 |
| 3,394,739 | * | 7/1968 | Crenshaw et al. | 139/21 |
| 4,456,035 | * | 6/1984 | Bruggemann et al. | 139/398 |
| 5,398,730 | * | 3/1995 | Derudder et al. | 139/21 |
| 5,400,831 | * | 3/1995 | Gheysen | 139/21 |
| 5,522,435 | * | 6/1996 | DeRudder | 139/65 |
| 5,655,573 | * | 8/1997 | Gheysen et al. | 139/21 |

FOREIGN PATENT DOCUMENTS

| | | | | |
|---|---|---|---|---|
| 4243237 | | 8/1994 | (DE) . | |
| 4312235 | | 10/1994 | (DE) . | |
| 0534515 | * | 8/1992 | (EP) | D03D/27/10 |

OTHER PUBLICATIONS

Van de Wiele, Michel, "Addendum weave catalog 1994", Sep. 21, 1994, entire document.*

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

A method is provided for weaving a false boucle fabric with a rib structure on weaving machines in successive weft insertion cycles. In each cycle a top (1), (2), (3) and a bottom weft thread (4), (5), (6) are inserted between binding warp threads (9–12) and pattern warp threads (13–16) of a series of warp thread systems so that a fabric is woven. Top (1–3) and bottom weft threads (4–6) are inwoven by a respective set of binding warp threads (9, 10), (11, 12), thereby weaving two backing fabrics. Respective pattern warp threads (13), (14); (15), (16) are interlaced in a respective backing fabric and are rib-formingly passed around over a top (2), (3) or bottom weft thread (5), (6) running between the backing fabrics which is not inwoven by binding warp threads (9–12), so that two fabrics (17), (18) with a rib structure are woven one above the other.

10 Claims, 1 Drawing Sheet

METHOD FOR WEAVING A FALSE BOUCLE FABRIC

Figure 1:
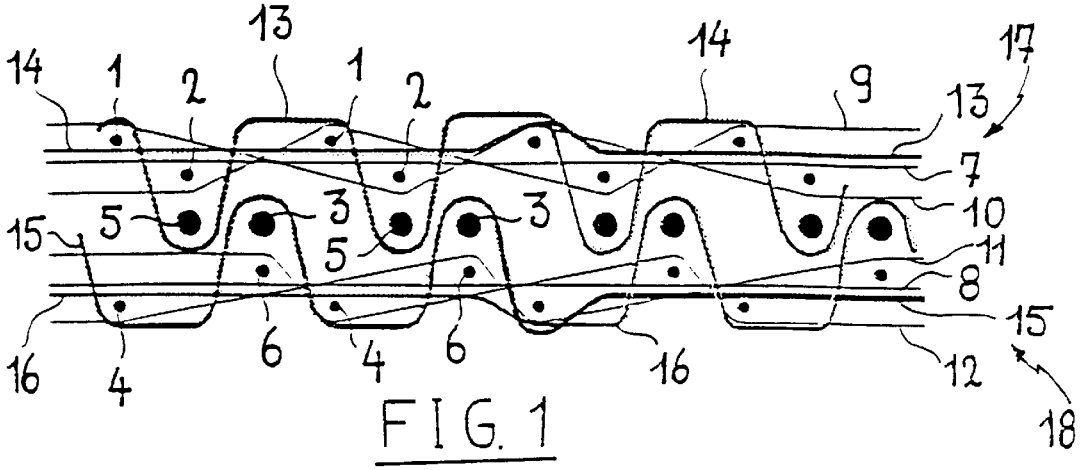

This invention relates to a method for manufacturing fabrics with a rib structure, whereby on a weaving machine in successive weft insertion cycles in each case a top and a bottom weft thread are inserted between warp threads of a series of warp thread systems so that, a fabric is woven in which warp threads are alternately interlaced in the fabric and are rib-formingly passed around over a weft thread.

This invention also relates to a fabric with rib structure manufactured according to this method.

A fabric with a rib structure which approximates the appearance of a loop pile fabric or bouclé fabric, is called a false bouclé fabric.

This invention relates in particular to a method for weaving a false bouclé fabric, and a false bouclé fabric that has been woven according to this weaving method.

According to a known weaving method for manufacturing a false bouclé fabric, which has the above mentioned characteristics, tension warp threads are inwoven stretched in the fabric and in each weft insertion cycle on the weaving machine two weft threads are simultaneously inserted one above the other. In successive insertion cycles the two weft threads are in relation to the tension warp threads alternately inserted along the top of the fabric and along the back of the fabric.

Two pattern warp threads with a different colour are provided in order to be able to make a design or a pattern visible with the two colours along the top of the fabric.

A first pattern warp thread is alternately brought above the two weft threads along the top of the fabric and interlaced between the two weft threads along the back of the fabric, in order to implement a rib structure on the top of the fabric and to form the design or the pattern.

A second pattern warp thread is alternately interlaced between the two weft threads along the top of the fabric and brought under the two weft threads along the back of the fabric. The colour of the second pattern warp thread is then visible on the back of the fabric. The second pattern warp thread forms a rib structure on the back of the fabric. With these fabrics the weft threads are inwoven by the pattern warp threads.

With each insertion cycle a rib line is produced (alternately along the top and along the back of the fabric). On the back of the fabric a type of negative (with swapped colours) is obtained of the two-coloured design which is visible on the top of the fabric.

Manufacturing fabrics with a rib structure on a weaving machine can be effected according to this known method but with an average productivity.

The purpose of this invention is to provide a method for weaving a fabric with a rib structure, which can be utilised on a weaving machine which is provided for inserting two weft threads per weft insertion cycle, and with which a considerably higher productivity can be achieved than with the known method.

This objective is achieved according to this invention with a method having the characteristics mentioned in the first paragraph of this specification, by providing binding warp threads and pattern warp threads in each warp thread system, so that top and bottom weft threads are inwoven by a respective set of binding warp threads whereby two backing fabrics are woven, and so that respective pattern warp threads are alternately interlaced in a respective backing fabric and are rib-formingly passed around over a top or bottom weft thread running between the backing fabrics which is not inwoven by binding warp threads, so that two fabrics with a rib structure are woven one above the other.

According to the method according to this invention on a weaving machine two fabrics can be woven simultaneously. The application of this method instead of the known method therefore doubles the productivity. This method can be utilised on a weaving machine which is provided for inserting two weft threads per weft insertion cycle, such as for example a double rapier weaving machine.

According to a greatly preferred method according to this invention the weft threads are inserted in successive series of three weft insertion cycles, whereby of the weft threads inserted in each series in each case two top weft threads are inwoven in the top backing fabric and two bottom weft threads are inwoven in the bottom backing fabric, while around the two other weft threads a respective rib is formed by a pattern warp thread interlaced in the top backing fabric and by a pattern warp thread interlaced in the bottom backing fabric.

This method can be so utilised that the pattern warp threads interlaced in the top backing fabric are rib-formingly passed around over a bottom weft thread while the pattern warp threads interlaced in the bottom backing fabric are rib-formingly passed around over a top weft thread.

With a fabric manufactured according to this method the ribs are formed above two weft threads running one above the other. In such a fabric the rib height is rather great, through which a very clear rib structure is obtained.

The rib-forming pattern warp threads must with this method be capable in each weft insertion cycle of being brought "above" and "below" the two insertion levels of the weaving machine. In order to inweave non-rib-forming (parts of) pattern warp threads in a backing fabric these pattern warp threads must furthermore also be capable of being brought into a position "between" the insertion levels. The utilisation of this method therefore requires a three-position open-shed jacquard machine.

This method is for example so utilized that the pattern warp thread interlaced in the top backing fabric forms a rib around the bottom weft thread which is inserted during the second weft insertion cycle of each series and the pattern warp thread interlaced in the bottom backing fabric forms a rib around the top weft thread which is inserted during the third weft insertion cycle of each series.

In order to remedy the disadvantage that the above described method requires a three-position open-shed jacquard machine, the method according to this invention is so implemented that the pattern warp threads interlaced in the top backing fabric are rib-formingly passed around over a top weft thread, while the pattern warp threads interlaced in the bottom backing fabric are rib-formingly passed around over a bottom weft thread.

On the one hand both the formation of ribs with the pattern warp threads interlaced in the top backing fabric and the inweaving of non-rib-forming (dead) pattern warp threads in the top backing fabric can be performed with the positions "above" and "between" the insertion levels.

On the other hand both the formation of ribs with the pattern warp threads interlaced in the bottom backing fabric and the inweaving of non-rib-forming (dead) pattern warp threads in the bottom backing fabric can be performed with the positions "between" and "below" the insertion levels.

This method can therefore be implemented utilising a two-position open-shed jacquard machine. The jacquard machine must furthermore only perform half the total lifting.

According to this method the weft threads are, as mentioned above, preferably inserted in successive series of three weft insertion cycles, so that the pattern warp thread interlaced in the top backing fabric forms a rib around the top weft thread which is inserted during the third weft insertion cycle of each series, and so that the pattern warp thread interlaced in the bottom backing fabric forms a rib around the bottom weft thread which is inserted during the third weft insertion cycle of each series.

With the method according to this invention the height of the ribs in the fabric can be increased by taking thicker threads for the weft threads which support ribs than for the other weft threads. Because of this the loop effect of the rib structure is increased and a good approximation to the appearance of a loop pile fabric or a bouclé fabric is obtained.

The non-rib-forming pattern warp threads or parts of pattern warp threads (called the dead pattern warp threads in that which follows) are preferably inwoven in a backing fabric.

According to this method, per warp thread system, a respective tension warp thread is preferably also inwoven in each backing fabric. The inwoven dead pattern warp threads and the tension warp threads moreover extend together in the backing fabrics.

Figure 2:
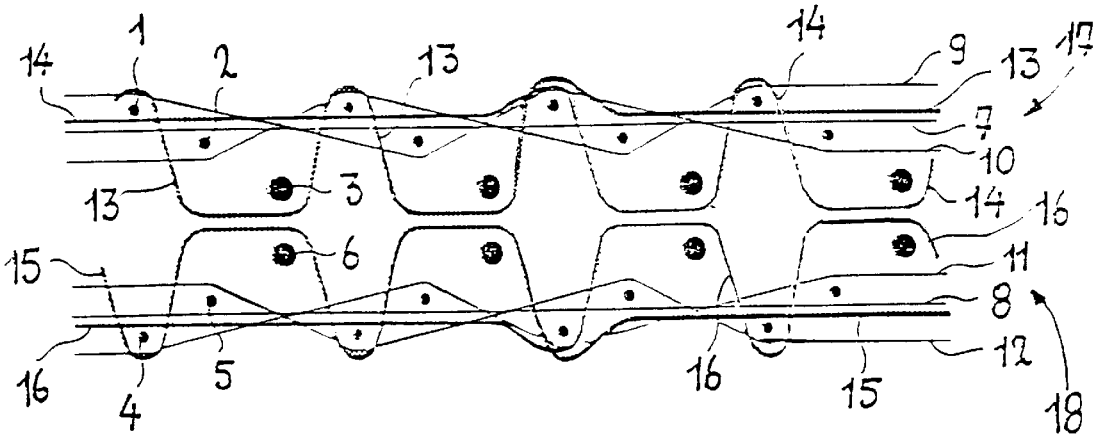
Figure 3:
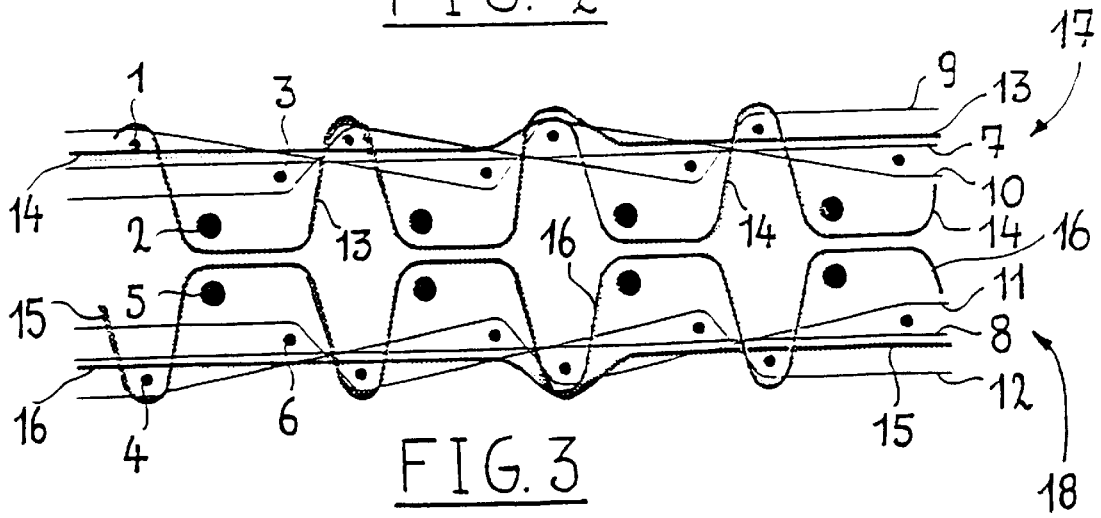

This invention will now be further explained in the following specification of a number of methods for manufacturing false bouclé fabrics according to this invention. These methods are only described by way of example and no part of the following specification may therefore be considered as restrictive to the protection claimed by this patent application. In this specification reference is made to FIGS. 1, 2 and 3 attached hereto and provided with reference numbers, which represent schematic cross-sections according to the direction of the warp threads of false bouclé fabrics, respectively manufactured according to a first, a second and a third variant method according to this invention.

According to a first variant method according to this invention (see FIG. 1) on a double rapier weaving machine a number of warp thread systems are provided which respectively comprise two tension warp threads (7), (8), four binding warp threads (9), (10), (11), (12), and four pattern warp threads (13), (14), (15) (16).

During successive weft insertion cycles in each case a top weft thread (1), (2), (3) and a bottom weft thread (4), (5), (6) are simultaneously inserted between the warp threads (7–16).

The various warp threads (7–16) are brought into the correct position in relation to the two insertion levels prior to each weft insertion in order to obtain the path schematically represented in FIG. 1 of the warp threads (7–16) in relation to weft threads (1–3), (4–6), whereby two fabrics with a rib structure are woven one above the other.

Moreover two backing fabrics are formed, whereby each backing fabric in each warp thread system comprises two binding warp threads (9), (10); (11), (12) which cross each other repeatedly and enclose two weft threads (1), (2); (4), (6) in each opening formed between two crossings, and comprise a tension warp thread (7), (8) which extends between the two weft threads which are in the respective openings between binding warp threads.

Each fabric (17), (18) also comprises two pattern warp threads (13), (14); (15) (16) in each warp thread system which alternately form ribs, because of the fact that they are alternately interlaced in the fabric by a weft thread (1), (4) and are rib-formingly passed around over a thicker weft thread (5), (3) which extends between the two backing fabrics.

The positions of the various warp threads (7–16) in relation to the weft threads (1–6) are in each case repeated after a series of three successive weft insertion cycles. The top weft thread (1) and the bottom weft thread (4) which are inserted during the first weft insertion cycle of a number of successive series of three insertion cycles, are respectively inwoven in the top and the bottom backing fabric.

The top (2) and the bottom weft thread (5) which are inserted during the second weft insertion cycle of the successive series, are respectively inwoven in the top backing fabric and provided between the two backing fabrics. During this second weft insertion cycle no weft thread is inwoven in the bottom backing fabric.

The top and the bottom weft thread (6) which are inserted during the third weft insertion cycle of the successive series, are respectively provided between the two backing fabrics and inwoven in the bottom backing fabric. During this third weft insertion cycle no weft thread is inwoven in the top backing fabric.

A pattern warp thread (13), (14) is alternately interlaced in the top backing fabric by a weft thread (1) and rib-formingly passed around over the weft thread (5) which during the second weft insertion cycle is provided between the two backing fabrics.

Another pattern warp thread (15), (16) is alternately interlaced in the bottom backing fabric by a weft thread (4) and rib-formingly passed around over the weft thread (3) which during the third weft insertion cycle is provided between the two backing fabrics.

The non-rib-forming parts of the pattern warp threads (13–16) are inwoven in the backing fabric married to the tension warp threads (7), (8).

According to a second variant method according to this invention (see FIG. 2) the pattern warp threads (13–16) are positioned by means of a two-position open-shed jacquard machine. This method also differs further from the first variant method because of the fact that the two weft threads which are provided for supporting the ribs between the backing fabrics are now respectively the top (3) and the bottom weft thread (6) which is inserted during every third weft insertion cycle of the successive series. These weft threads (3), (6) are one above the other so that the rib-forming pattern warp threads (13), (15) run between the two weft threads (3), (6). Of the weft threads (1), (2); (4), (5) which are inserted during the first and the second weft insertion cycle the respective top weft threads (1), (2) are inwoven in the top backing fabric and the respective bottom weft threads (4), (5) inwoven in the bottom backing fabric.

A third variant method (see FIG. 3) differs from the second, only because of the fact,that the weft threads (2), (3) which support the ribs are now inserted during the second weft insertion cycle.

This invention makes it possible, when weaving fabrics with a rib structure on a weaving machine which can only insert two weft threads per weft insertion cycle, to increase productivity to a great degree.

What is claimed is:

1. Method for weaving fabrics with a rib structure on a weaving machine in successive weft insertion cycles comprising inserting in each cycle a top and a bottom weft thread between warp threads of a series of warp thread systems, weaving a fabric having warp threads alternately interlaced in the fabric, rib-formingly passing the warp threads around over each weft thread, providing binding warp threads and pattern warp threads in each warp thread system so that the top and bottom weft threads are inwoven by a respective set of binding warp threads thereby weaving two backing fabrics, alternately interlacing respective pattern warp threads in a respective backing fabric and rib-formingly passing the warp threads not inwoven by the binding warp around over the top or the bottom weft thread running between the backing fabrics and thereby weaving the two backing fabrics with a rib structure one above another.

2. The method of claim 1, further comprising inserting the weft threads in successive series of three weft insertion cycles, inweaving two top weft threads of the weft threads inserted in each series in each case in the top backing fabric, inweaving two bottom weft threads in the bottom backing fabric, and forming a respective rib around two other weft threads by a pattern warp thread interlaced in the top backing fabric and by a pattern warp thread interlaced in the bottom backing fabric.

3. The method of claim 1, further comprising interlacing the pattern warp threads in the top backing fabric by rib-formingly passing around a bottom weft thread, and interlacing the pattern warp threads in the bottom backing fabric by rib-formingly passing around over a top weft thread.

4. The method of claim 3, wherein the interlacing of the pattern warp thread in the top backing fabric forms a rib around the bottom weft thread inserted during the second weft insertion cycle of each series and wherein the interlacing of the pattern warp thread in the bottom backing fabric forms a rib around the top weft thread inserted during the third weft insertion cycle of each series.

5. The method of claim 1, further comprising interlacing the pattern warp threads in the top backing fabric by rib-formingly passing around over a top weft thread and interlacing the pattern warp threads in the bottom backing fabric by rib-formingly passing around over a bottom weft thread.

6. The method of claim 1, further comprising interlacing the pattern warp thread in the top backing fabric for forming a rib around the top weft thread inserted during the third weft insertion cycle of each series and interlacing the pattern warp thread in the bottom backing fabric for forming a rib around the bottom weft thread inserted during the third weft insertion cycle of each series.

7. The method of claim 1, further comprising providing the weft threads supporting the rib structure with greater thickness than the other weft threads.

8. The method of claim 1, further comprising inweaving a non-rib-forming part of a pattern warp thread in the backing fabrics.

9. The method of claim 1, further comprising inweaving in every warp thread system a respective tension warp thread in each backing fabric.

10. The method of claim 1, wherein the fabrics are false boucle fabrics.

* * * * *